United States Patent [19]

Posey et al.

[11] Patent Number: 4,783,947

[45] Date of Patent: Nov. 15, 1988

[54] APPARATUS FOR REMOVING LIQUID AND RESIDUE FROM A WEB OF FILM

[75] Inventors: John L. Posey, McHenry; Ronald W. Swank, Crystal Lake; Martin E. Sliva, Cary; John E. Picken, Crystal Lake, all of Ill.

[73] Assignee: Baxter Travenol Laboratories, Inc., Deerfield, Ill.

[21] Appl. No.: 30,655

[22] Filed: Mar. 25, 1987

[51] Int. Cl.[4] ..... B65B 61/00

[52] U.S. Cl. ..... 53/167; 15/306 A; 15/345; 34/156; 53/426; 53/551

[58] Field of Search ..... 15/306 A, 345, 346; 34/156; 53/167, 426, 550, 551, 451

[56] References Cited

U.S. PATENT DOCUMENTS

| | | | |
|---|---|---|---|
| 2,234,153 | 3/1941 | Herbert . | |
| 2,967,119 | 1/1961 | Gutterman . | |
| 3,158,886 | 12/1964 | Grimes . | |
| 3,370,982 | 2/1968 | Hayunga | 15/306 A X |
| 3,383,831 | 5/1968 | Goldsmith . | |
| 3,440,003 | 4/1969 | Tuma . | |
| 3,495,932 | 2/1970 | Tuma | 53/167 X |
| 3,543,410 | 12/1970 | Trachtenberg | 34/156 X |
| 3,720,141 | 3/1973 | Stock . | |
| 3,929,409 | 12/1975 | Buchner et al. . | |
| 3,947,249 | 3/1976 | Egger | 53/167 X |
| 4,026,701 | 5/1977 | Till et al. | 15/306 A X |
| 4,053,990 | 10/1977 | Bielinski | 34/156 X |
| 4,437,200 | 3/1984 | Sando et al. | 15/306 A |
| 4,454,621 | 6/1984 | Testone | 15/306 A X |
| 4,532,753 | 8/1985 | Kovacs | 53/451 |
| 4,606,137 | 8/1986 | Whipple | 34/156 |
| 4,656,813 | 4/1987 | Baldini et al. | 53/167 |

FOREIGN PATENT DOCUMENTS

| | | |
|---|---|---|
| 2339128 | 10/1980 | Fed. Rep. of Germany . |
| 715702 | 9/1954 | United Kingdom . |

*Primary Examiner*—James F. Coan
*Assistant Examiner*—Steven P. Weihrouch
*Attorney, Agent, or Firm*—Paul C. Flattery; Robert M. Barrett; Mary R. Jankousky

[57] ABSTRACT

An apparatus for removing liquid and residue from a web of film is provided. The apparatus includes an exhaust tube having an inlet and an outlet, the web of film passing through the exhaust tube from the inlet through the outlet, the exhaust tube being under a negative pressure. Two air knives are located above the outlet of the exhaust tube, one air knife being located on a first side of the film and second air knife being located on a second side of the film, the air knives include a plurality of holes for directing a gas for removing the liquid and residue onto the web of film. The exhaust tube cooperates with the air knives to capture a portion of the removed liquid and residue.

20 Claims, 3 Drawing Sheets

29
57
48
44
46
21
20
54
53
60
58
25
23
15
56
33
55
51
V
31
39
35
34

APPARATUS FOR REMOVING LIQUID AND RESIDUE FROM A WEB OF FILM

This invention relates generally to apparatus for removing liquid and residue from a web of film. More specifically, this invention relates to air knives for removing liquid and residue from a web of film in a packaging machine.

Typically, in the packaging area it is necessary for a web of film to be washed, cleaned, or sterilized prior to its creation into a package for housing a product. For example, in packaging processes for creating products for human consumption or infusion, it is common to treat a web of film that is fed into the machine with a liquid sterilant or wash that includes water, chemical sterilants, or wetting agents. The chemical or liquid sterilant sterilizes and/or cleans the web of film so that it can be utilized to create a sterile product. Sterilization and cleansing of the film is critical, for example, in the medical industry, when one is packaging parenteral or enteral products. This sterilization step is especially critical if the resultant product is not to be terminally sterilized, i.e., if the packaging machine is an aseptic packaging machine.

After the film has been washed, cleaned, or sterilized, liquid and other residue, for example a chemical sterilant or wetting agent such as hydrogen peroxide typically remains on the film. Accordingly, it is necessary to remove the liquid and/or residue from the film. Again, this is especially true when chemical sterilants are used and the resultant packaged product is for human consumption or infusion. For example, current FDA regulations require that hydrogen peroxide residue not be greater than 0.1 ppm.

To remove liquid and other residue, air knives have been utilized. In its basic form, an air knife comprises an apparatus for blowing a stream of air across a web of film so that the liquid contained thereon is blown off the film. The goal of an air knife is to remove the liquid contained on the film thereby reducing residue and drying the film. Accordingly, an air knife must remove as much liquid and residue as possible.

It is known in the packaging art to utilize an air knife that comprises an elongated tube having a slit along its length through which air is blown. Typically, two air knives are situated one on each side of the web of film and the air is blown onto the web of film through the slits. However, typically the liquid and residue containing air blown off the film is free to circulate in the remaining portions of the packaging machine in which the air knives are used. Accordingly, the blown off residues and liquids may find their way back onto previously dried film, or, increase the amount of residue and liquid on film that has not yet been exposed to the air knives.

Typically, air knives are difficult to sterilize because of their location, cleanability and drainability. It is also difficult to dry the air knives. The air knife is usually located in a critical area of the machine that is not easily sterilized with chemicals.

Accordingly, there is a need for an improved air knife, especially for use in a packaging machine.

The present invention provides an apparatus for removing liquid and residue from a web of film. The apparatus includes means for blowing a gas onto the web of film, the means including a gas inlet at an end thereof and aperture means for allowing the gas to exit the means for blowing and be blown onto the film. The apparatus also includes exhaust means for capturing at least a portion of the residue and liquid blown of the film. The web of film passing through slots in the exhaust means and past the means for blowing which is located downstream of the exhaust means.

Preferably, the aperture means comprises a plurality of holes along the length of the means for blowing. Preferably, the inside cross-sectional area of the means for blowing is greater than a sum of the area of all the holes.

Preferably, the means for blowing and exhaust means are at least partially surrounded by a chamber means, the chamber means including a film inlet slot and a film outlet slot. The chamber means preferably has a greater positive pressure than a pressure outside the chamber means.

Most preferably, two means for blowing and exhaust means are provided. One means for blowing and exhaust means being located upstream along the film feed path from the other means for blowing and exhaust means.

The present invention also provides a system for sterilizing the apparatus for removing liquid and residue. The system comprises means for intermittently introducing steam into each air knife along with the chemical or liquid sterilant to sterilize the air knives.

Accordingly, an advantage of the present invention is to provide an improved apparatus for removing liquid and residue from a web of film.

A still further advantage of the present invention is that it provides an air knife for use in a packaging machine.

Moreover, an advantage to the present invention is that it provides an aseptic air knife for use in an aseptic packaging machine.

Additionally, an advantage to the air knife of the present invention is that it provides an exhaust means for capturing at least a portion of the liquid and residue blown off the web of film.

Still an additional advantage of the present invention is that it provides an air knife with a plurality of holes and accordingly provides a more uniform distribution of air across the web of film.

Moreover, an advantage of the present invention is that it provides two sets of air knives to insure that the web of film is dried and the majority of residues are removed.

Furthermore, an advantage of the present invention is that it provides an improved system for sterilizing the apparatus for removing liquid and residue from film.

A still additional advantage of the present invention is that the air knives are removably secured within the apparatus so that they may be removed for repair or inspection and can be positively replaced in an identical manner.

Another advantage of the present invention is that it provides a modular system for use in a packaging machine.

Additional features and advantages of the present invention are described in, and will be apparent from, the detailed description of the presently preferred embodiments and from the drawings.

The present invention provides an apparatus for removing liquid and other residue from a web of film. The apparatus can be utilized, in a preferred embodiment, to remove liquid and other residue from a web of film that is being fed into a packaging machine. In a most preferred embodiment, the apparatus can be utilized to remove liquid and other residue in a form, fill, seal packaging machine that is utilized to make flexible containers for packaging, for example, parenteral and enteral products.

Figure 1:
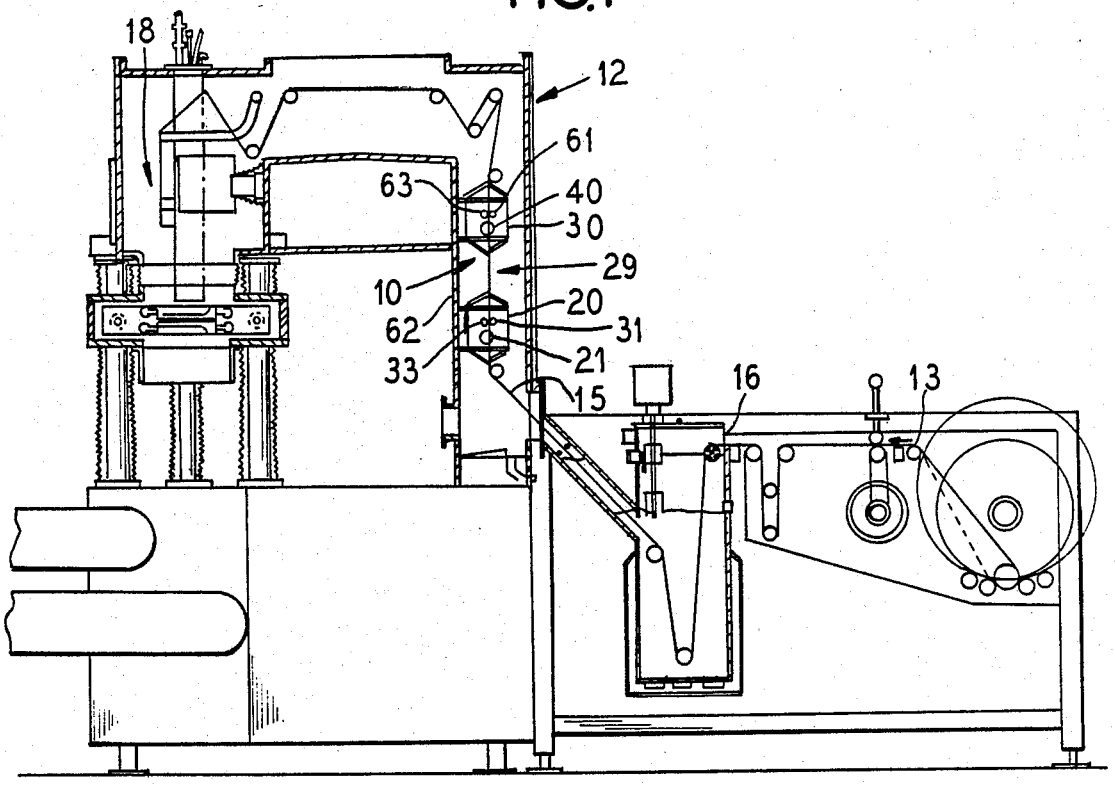
FIG. 1 illustrates a perspective view of a form, fill and seal packaging machine having the apparatus for removing liquid and residue of the present invention.

Referring now to FIG. 1, the apparatus for removing liquid and other residue 10 is illustrated in a form, fill, seal packaging machine 12. Briefly, the form, fill and seal packaging machine includes a film station 13 that feeds a web of film 15 into a bath 16 for washing or sterilizing the film. The film is fed to the apparatus for removing liquid and residue 10 and then to the packaging station 18 of the machine 12 where the film 15 is created into flexible packages.

In the preferred embodiment illustrated, the apparatus 10 includes two internal chambers 20 and 30 respectively. Each internal chamber 20 and 30 has a similar construction. As illustrated, the web of film 15 passes through the first internal chamber 20 and then through the second internal chamber 30. Although two internal chambers 20 and 30 are illustrated, the apparatus 10 can include only one internal chamber and accompanying apparatus situated therein or can include more than two internal chambers. By utilizing two internal chambers 20 and 30 and accompanying apparatus 10, one is assured that the web of film 15 is dried and any residues are removed.

The internal chambers 20 and 30 are secured within a cabin 29. In an aseptic form, fill, seal packaging machine, the cabin 29 comprises a sterile cabin that is under a positive pressure of sterile airflow. Of course, the internal chambers 20 and 30 can be situated or located in other portions of the machines in which they are being used.

Before the web of film 15 enters the first internal chamber 20, it has been washed, cleaned and/or sterilized by being passed through or sprayed with a liquid sterilant or cleaner. For example, in the form, fill, seal packaging machine 12 illustrated, the web of film 15 passes through a bath 16. Accordingly, the film 15 may still be wet and include residues that must be removed. For example, it is known to pass a web of film 15 through a hydrogen peroxide/water solution to sterilize and/or wash the film. After passing through a hydrogen peroxide solution, the web of film 15 will probably have on its surface hydrogen peroxide/water solution and hydrogen peroxide residue that must be removed. To remove the hydrogen peroxide residue, heated air can be blown across the web of film 15 to cause the hydrogen peroxide to vaporize. The resultant water is blown off the web of film 15 by the air knife and accordingly the film is dried.

Figures 2, 4, 6:
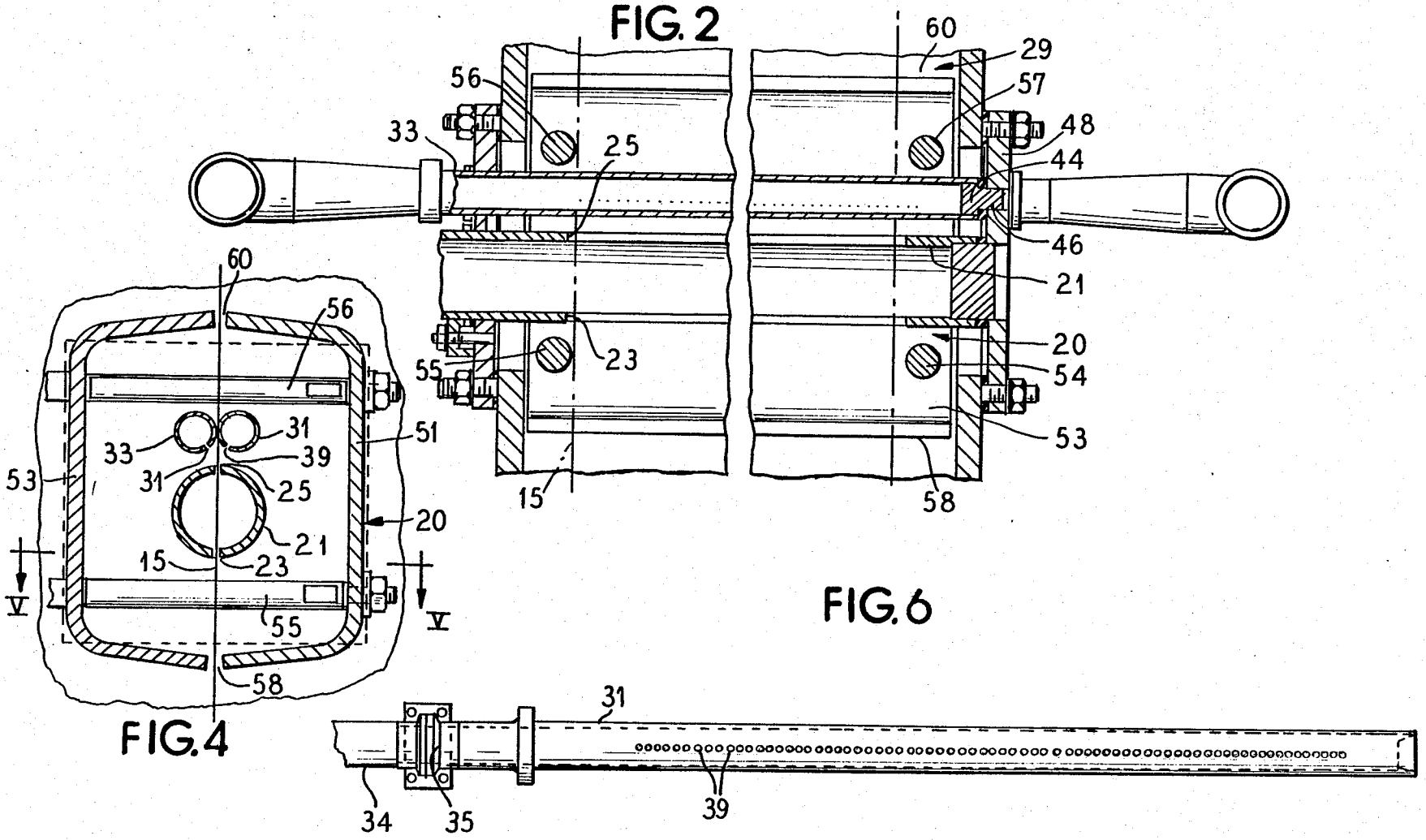
FIG. 2 illustrates a cross-sectional view of the apparatus for removing liquid and residue of the present invention.
FIG. 4 illustrates a cross-sectional view of the apparatus for removing liquid and residue.
FIG. 6 illustrates a perspective view of the air knife alone.

Referring now to FIGS. 2 and 4, a cross-sectional view of the internal chamber 20 and apparatus for removing liquid and residue 10 of the present invention is illustrated. Although only the first internal chamber 20 and accompanying structure is illustrated, the second internal chamber 30 has a similar construction.

As illustrated, located within the internal chamber 20 is an exhaust tube 21 that has a film inlet 23 and a film outlet 25. The film inlet 23 and outlet 25 cooperate to allow the web of film 15 to pass through the exhaust tube 21. To this end, the film inlet 23 has a sufficient width and length to allow the web of film 15 to pass therethrough. The film outlet 25 is larger than the inlet 23, because, as will be discussed in more detail below, the outlet also functions to capture a portion of the liquid and residue blown off the film 15.

The exhaust tube 21 is secured to a fume exhaust vacuum pump or similar means that effects a negative pressure within the exhaust tube. Accordingly, the exhaust tube 21 exerts a vacuum pressure. As will be discussed in more detail below, this allows the exhaust tube 21 to capture, through the outlet 25, at least a portion of the liquid and residue blown off the web of film 15. The fume exhaust can be any means known in the art. An example of a fume exhaust that has been found to work satisfactory is manufactured by the New York Blower.

Located downstream from the exhaust tube 21 along the web of film path are two elongated air knives 31 and 33. The first air knife 31 is located on one side of the web of film 15 and the second air knife 33 is located on the second side of the web of film. The air knives 31 and 33 cooperate to blow at least a portion of the liquid and residues off the web of film 15.

FIG. 6 illustrates an air knife 31. The other air knife 33 has a similar construction. As illustrated, the air knife 31 includes an air inlet 35. The air inlet 35 allows pressurized air to flow into the air knife 31. To this end, the end of the air knife having the air inlet 35 is secured by a continuous tube 34 to the sterile air supply.

The air knife 31 includes a plurality of holes 39 located along the length of the air knife. The holes 39 allow pressurized air to be blown onto the web of film 15 removing at least a portion of the liquid and residue contained thereon. Preferably, the holes 39 extend along the length of the air knife 31 for a distance that is equal to at least the width of the web of film 15. Accordingly, the whole width of the web of film 15 is exposed to pressurized air via the holes. Because the air knives 31 and 33 include a plurality of holes rather than a slit, as in some prior art air knives, a more uniform distribution of the pressurized air across the web of film 15 is effected.

To insure that the air knives 31 and 33 have a positive pressure and pressurized air exits the holes 39, the inside cross-sectional area of the air knife is greater than the sum of the area of each of the holes. This provides an equal distribution of air within the air knives 31 and 33.

Each air knife 31 and 33 includes a hole (not shown) in its bottom portion. This hole allows hydrogen peroxide or other sterilant to be drained out of the air knife. As discussed in detail below, in a presterilization cycle, the air knives 31 and 33 are fogged with hydrogen peroxide and high quality steam.

The air knives 31 and 33 are secured in position by being locked in by a slot and key arrangement. To this end located at the end of each air knife, is a fitting that mates with a sanitary fitting on the sterile air supply. Furthermore, an end 44 of the air knife 31 is designed to be received within a notch 46 in a side 48 of the cabin 29. Accordingly, the air knives 31 and 33 are removably secured within the internal chamber 20. Accordingly, one is able to disassemble the air knives 31 and 33 for repair or inspection by pulling the air knives 31 and 33 out.

As illustrated in FIG. 4, the holes 39 in the air knives 31 and 33 are oriented at an angle of approximately 25° to about 35° with respect to the web of film 15. This angle can be important in insuring proper removal of the liquid and residue from the web of film 15.

The air knives 31 and 33 are located above the exhaust tube 21. Accordingly, at least a portion of the liquid and residue that is blown off the web of film 15 is captured by the exhaust tube 21. To this end, the outlet film end 25 of the exhaust tube 21 has a sufficiently large width and length to allow a portion of the residue and liquid to be captured therein. Moreover, because a vacuum pressure is exerted by the exhaust tube 21, there is a tendency for fluid to flow from the film 15, as it is blown off the film, into the exhaust tube. Accordingly, instead of being vented into the remaining portions of the internal chamber 29, at least a portion of the liquid and residue is vented into the exhaust tube 21 and accordingly, cannot contaminate the remaining portions of the web of film 15.

Figure 3:
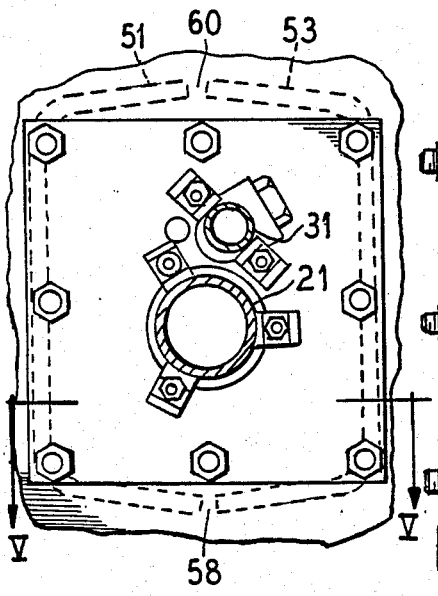
FIG. 3 illustrates a side elevational view of a portion of the apparatus for removing liquid and residue of the present invention.
Figure 5:
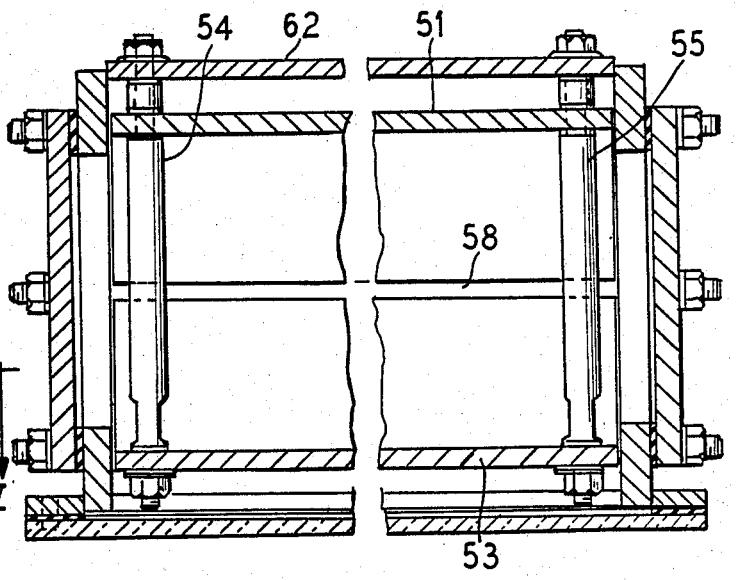
FIG. 5 illustrates a cross-sectional view taken along lines V—V of FIG. 3.

FIGS. 3, 4 and 5 illustrate the construction of the first chamber 20. Of course, the second chamber 30 has a similar construction. The first chamber 20 includes two wall members 51 and 53. The wall members 51 and 53 are secured together around the air knives 31 and 33 and exhaust tube 21, by four connection rods 54, 55, 56, and 57. The connection rods are constructed so that they secure the wall members 51 and 53 together at a predetermined distance from each other. Accordingly, an inlet slit 58 and outlet slit 60 is defined by wall members. The inlet slit allows the web of film 15 to flow into the chamber 20 and the outlet slit 60 allows the film to exit the chamber 20. The connection rods 54, 55, 56, and 57 are located at a distance sufficient to allow a web of film 15 to flow through the chamber.

The connection rods 54, 55, 56, and 57 also function to secure the chamber 20 within the cabin 29. To this end, the connection rods 54, 55, 56, and 57 are bolted, or affixed by other means, to a side 62 of the cabin 29.

From the exhaust tube 21, the residue and liquid captured is vented to the fume exhaust.

As illustrated in the embodiment illustrated in FIG. 1, preferably two internal chambers 20 and 30 and sets of air knives 31, 33 and 61, 63 and exhaust tubes 21 and 40 are utilized. This insures that the film 15 is dried and the majority of residues are removed. It has been found that by utilizing two sets of air knives 31, 33 and 61, 63 and two internal chambers 20 and 30 that a residue of 0.1 part per million in the final product is achieved. As previously stated, however, depending on the application, more than two, or less than two, air knives and chambers can be utilized.

Preferably, the air knives 31, 33 and 61, 63 are constructed from stainless steel. Most preferably, the air knives 31, 33 and 61, 63 are constructed from Type 315 steel. Likewise, the exhaust tubes 21 and 40 are preferably constructed from stainless steel, and most preferably 316 stainless steel. However, the air knives 31, 33 and 61, 63 and exhaust tubes 21 and 40 can be constructed from an corrosion resistant material.

The internal chambers 20 and 30 likewise can be constructed from any rust resistant material. Most preferably, the internal chambers 20 and 30 are constructed from a plastic resistant to hydrogen peroxide, for example polycarbonate.

As previously stated, in use in a packaging machine and specifically an aseptic packaging machine, the apparatus for removing liquid 10 can be contained in a sterile cabin 29. The sterile cabin 29 may have a positive pressure due to a HEPA system. The internal chambers 20 and 30 preferably are under a positive pressure that is slightly greater than the pressure in the sterile cabin 29. The pressure in the sterile cabin 29 is effected by the air knives. This insures that the residue and water blown off the web of film 15 is concentrated, to the extent possible, in the exhaust tube 21 and does not recontaminate the web of film.

Preferably, the gas that is blown onto the film 15 is heated. As previously stated, this vaporizes the hydrogen peroxide. Moreover, by applying heat to the web of film 15, it affords the film better sealing characteristics. This is especially desireable if the film is being processed in a form, fill, and seal packaging machine. Preferably, for economic reasons, the gas is air, however, other gases can be utilized such as nitrogen.

Figure 7:
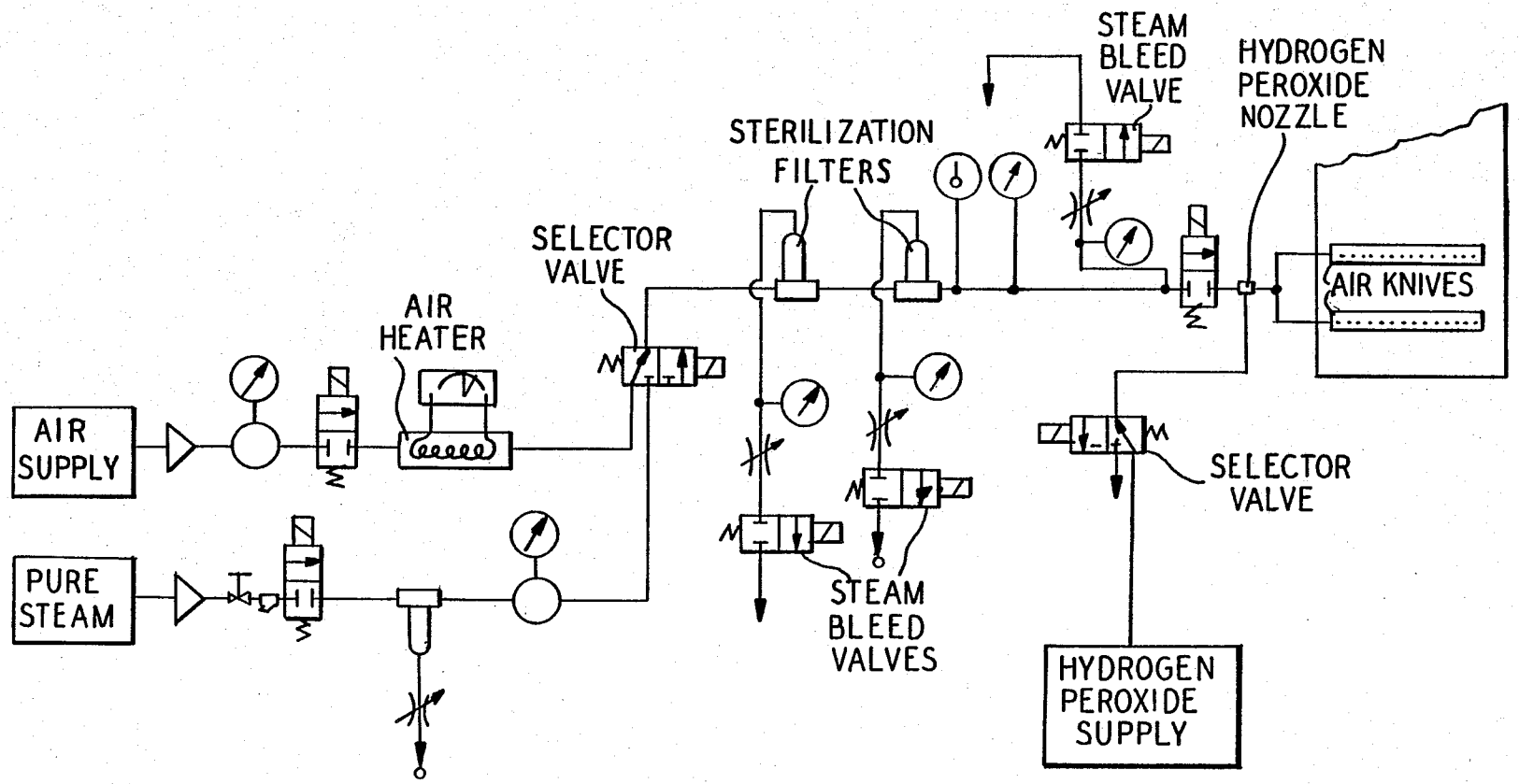
FIG. 7 illustrates a schematic view of the system for the apparatus for removing liquid and residue of the present invention.

Referring now to FIG. 7, a schematic illustrating the sterilization process of the air knives 31, 33 and 61, 63 and exhaust tubes 21 and 40 is set forth. As illustrated, the sterilization process comprises pulsing steam with hydrogen peroxide into the air knives. To this end, during the sterilization process, at start up, hydrogen peroxide is fed from a reservoir, such as for example a hydrogen peroxide bath, into the air knives. At the same time intermittently, steam is pulsed into the air knives. The heat from the steam, with the hydrogen peroxide mix, produces a lethal mixture that affords a very high kill (sterility assurance level $=10^{-6}$). The steam is pulsed into the air knives for 10 (ten) seconds every 5 (five) minutes during the sterilization process. The sterilization process lass for approximately 30 minutes.

The steam is pure steam and is passed through two 0.2 micron sterilization filters to control particulate. The steam is at a temperature of approximately 250° F. and enters the air knives at a temperature of 212° F. After the air knives have been sterilized, air is supplied to the air knives as has been previously disclosed in the specification. The air is heated to a temperature of approximately 225° F. and is also passed through two 0.2 micron sterilization filters to control particulate and sterilize the air. During normal operation only air is supplied to the knives and the valves allowing the flow of hydrogen peroxide or steam are closed.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim as our invention:

1. An apparatus for removing liquid and residue from a web of film comprising:

means for blowing gas onto the web of film, the means including a gas inlet at an end thereof and aperture means for allowing the gas to exit the means for blowing and be blown the film;

exhaust means for capturing at least a portion of the residue and liquid blown from the film, the exhaust means including a first opening and a second opening; and the web of film passing through openings in the exhaust means and the means for blowing being located downstream of the exhaust means and oriented in such a manner that at least a portion of the residue blown off the film, is blown toward the second opening, the second opening having a sufficient size so that at least a portion of the residue blown off the film is received within the second opening.

2. The apparatus of claim 1 wherein said aperture means includes a plurality of holes along a length of the means for blowing.

3. The apparatus of claim 2 wherein an inside cross-sectional area of the means for blowing is greater than a sum of the area of each hole.

4. The apparatus of claim 1 including two means for blowing, one means for blowing being located on a first side of the web of film and the second means for blowing being located on a second side of the web of film.

5. The apparatus of claim 1 wherein the means for blowing and exhaust means are at least partially surrounded by a chamber means, the chamber means including a film inlet slot and a film outlet

6. The apparatus of claim 5 wherein the chamber means has a positive pressure greater than a pressure outside the chamber means.

7. The apparatus of claim 1 wherein the gas being blown by the means for blowing is heated.

8. An apparatus for removing liquid and residue from a web of film comprising:

an exhaust tube having an inlet and an outlet, the web of film passing through the exhaust tube from said inlet through the outlet, the exhaust tube being under a negative pressure;

two air knives located above the outlet of the exhaust tube, one air knife being located on a first side of the film and a second air knife being located on a second side of the film, the air knives including a plurality of holes for directing a gas for removing the liquid and residue onto the web of film; and the outlet of the exhaust tube being so constructed and arranged that the exhaust tube cooperates with the air knives to capture at least a portion of the removed liquid and residue that is blown off the web of film.

9. The apparatus of claim 8 wherein the cross-sectional internal area of the air knives is greater than a sum of the area of each hole.

10. The apparatus of claim 8 wherein the exhaust tube and air knives åre at least partially enclosed by a chamber having a film inlet slot and a film outlet slot.

11. The apparatus of claim 8 including a second exhaust tube and a second pair of air knives located upstream along the web of film path.

12. The apparatus of claim 8 wherein the holes in the air knife are located at an angle of approximately 25° to about 35° with respect to the web of film.

13. An apparatus for removing liquid and other residue in a packaging machine comprising:

an exhaust tube having an inlet and an outlet, the web being received by the exhaust tube through the inlet and exiting the exhaust tube through the outlet, the exhaust tube being under a negative pressure and exerting a vacuum force;

two elongated air knives located downstream of the exhaust tube along the film path of the web of film, one of the air knives being located on a first side of the web of film and the second air knife being located on a second side of the web of film, each air knife including an air inlet means and a plurality of holes along its length for blowing air onto the web of film for removing liquid and residue;

the exhaust tube and air knives cooperating so that at least a portion of the removed liquid and residue is captured by the exhaust tube; and the elongated air knives and exhaust tube being enclosed within an internal chamber located within a cabin in the packaging machine, the cabin is under a positive pressure and the internal chamber is under a positive pressure greater than the positive pressure of the cabin.

14. The apparatus of claim 13 wherein the cross-sectional area of an interior of the air knife is greater than a sum of the areas defined by the holes in the air knives.

15. The apparatus of claim 13 wherein the air blown through the holes of the air knives is heated.

16. The apparatus of claim 13 including a second exhaust tube and a second set of air knives located downstream of the exhaust tube and air knives in the cabin.

17. The apparatus of claim 13 wherein the holes in the air knives are oriented at an angle of approximately 25° to about 35° with respect to the web of film.

18. In aseptic form, fill and seal packaging machine, an apparatus for removing liquid and residue from a web of film, the apparatus being located within a sterile cabin, comprising:

a first exhaust tube having a film inlet and a film outlet, the web of film passing through the exhaust tube, the exhaust tube including an interior under a negative pressure and exerting a vacuum force;

a first set of elongated air knives located downsteam of the exhaust tube along the film path, one of said air knives being located on a first side of the web of film and a second of said air knives being located on a second side of the web of film and the air knives including an air inlet and a plurality of holes for blowing air onto the web of film;

the exhaust tube cooperating with the air knives so that at least a portion of the removed residue and liquid is captured by the exhaust tube; and the exhaust tube and air knives being at least partially enclosed by a first internal chamber having a film inlet and a film outlet.

19. The apparatus of claim 18 including a second exhaust tube, a second set of elongated air knives, and a second internal chamber located upstream of the film path of the web of film.

20. The apparatus of claim 18 wherein the sterile cabin is under a positive pressure and the internal chamber is under a greater pressure.

* * * * *

UNITED STATES PATENT AND TRADEMARK OFFICE

CERTIFICATE OF CORRECTION

PATENT NO. : 4,783,947

DATED : November 15, 1988

INVENTOR(S) : John L. Posey, Ronald W. Swank, Martin E. Sliva, and John E. Picken It is certified that error appears in the above-identified patent and that said Letters Patent is hereby corrected as shown below:

In column 7, at line 27, after "outlet" add --slot.--

Signed and Sealed this

Third Day of October, 1989

*Attest:*

*Attesting Officer*

DONALD J. QUIGG

*Commissioner of Patents and Trademarks*